US006402141B1

(12) United States Patent
Verstraeten

(10) Patent No.: US 6,402,141 B1
(45) Date of Patent: Jun. 11, 2002

(54) AUTOMATIC DICE GAME MACHINE

(75) Inventor: Eric Verstraeten, Sint Niklaas (BE)

(73) Assignee: Elaut N.V. (BE)

( * ) Notice: Subject to any disclaimer, the term of this patent is extended or adjusted under 35 U.S.C. 154(b) by 0 days.

(21) Appl. No.: 09/367,231

(22) PCT Filed: Feb. 20, 1998

(86) PCT No.: PCT/BE98/00024

§ 371 (c)(1),
(2), (4) Date: Feb. 4, 2000

(87) PCT Pub. No.: WO98/41296

PCT Pub. Date: Sep. 24, 1998

(30) Foreign Application Priority Data

Feb. 27, 1999 (BE) ..... 9700174

(51) Int. Cl.[7] ..... A63F 9/04; G07F 17/34

(52) U.S. Cl. ..... 273/145 C; 273/145 R; 273/145 B; 273/144 B; 273/138.2; 273/138.3; 463/22

(58) Field of Search ..... 273/144 R, 145 R, 273/145 A, 145 B, 145 C, 145 CA, 145 D, 145.8, 144 A, 144 B, 138.2, 138.3; 463/16, 17, 18, 22

(56) References Cited

U.S. PATENT DOCUMENTS 418,069 A * 12/1889 Rogers ..... 273/145 R
1,706,465 A * 3/1929 Rosenblatt ..... 273/145 R
2,693,962 A * 11/1954 Stevens ..... 273/145 R
3,175,826 A 3/1965 Davis
4,892,311 A * 1/1990 Zaitsu ..... 273/145 D
4,909,513 A * 3/1990 Kiyono ..... 273/145 R
5,031,913 A * 7/1991 Hirosumi et al. ..... 273/145 C
5,694,045 A * 12/1997 Ikeda et al. ..... 273/145 R
5,885,157 A * 3/1999 Harada et al. ..... 463/22

FOREIGN PATENT DOCUMENTS

| | | |
|---|---|---|
| EP | 0426301 | 5/1991 |
| EP | 0615775 | 9/1994 |
| FR | 822137 | 12/1937 |
| GB | 1180560 | 2/1970 |
| WO | 84/02281 | 6/1984 |

* cited by examiner

*Primary Examiner*—Jessica Harrison
(74) *Attorney, Agent, or Firm*—Banner & Witcoff, Ltd.

(57) ABSTRACT

The invention is for an automatic dice game machine where according to the invention dice are thrown down a slope until they come to a standstill on a horizontal surface, the dice which are provided with symbols and code marks are then compared by a reading unit comprising several code readers with a present winning combination, after which the dice are moved by means of a horizontal motion into the dice thrower, which has in the meantime been lowered down and finally the dice thrower is moved upwards to its starting position.

12 Claims, 4 Drawing Sheets

AUTOMATIC DICE GAME MACHINE

SUMMARY OF THE INVENTION

The invention is for an automatic dice game machine in which according to the invention the dice are thrown by a dice thrower downwards over an inclined plane until they come to rest on a horizontal plane, furthermore the dice, which are provided with symbols and code marks, are compared with a preset winning combination by a reading unit provided with several code readers, after which the dice are again moved by a horizontal movement into the dice thrower which has in the meantime been moved downwards and finally the dice thrower is moved up to its starting position

BRIEF DESCRIPTION OF THE DRAWINGS

By way of example and without in any way attempting to be exhaustive a more detailed description of a preferred embodiment of the automatic dice game machine in accordance with the invention is given in the following. This description refers to the attached drawings in which.

DETAILED DESCRIPTION OF THE INVENTION

Figure 1:
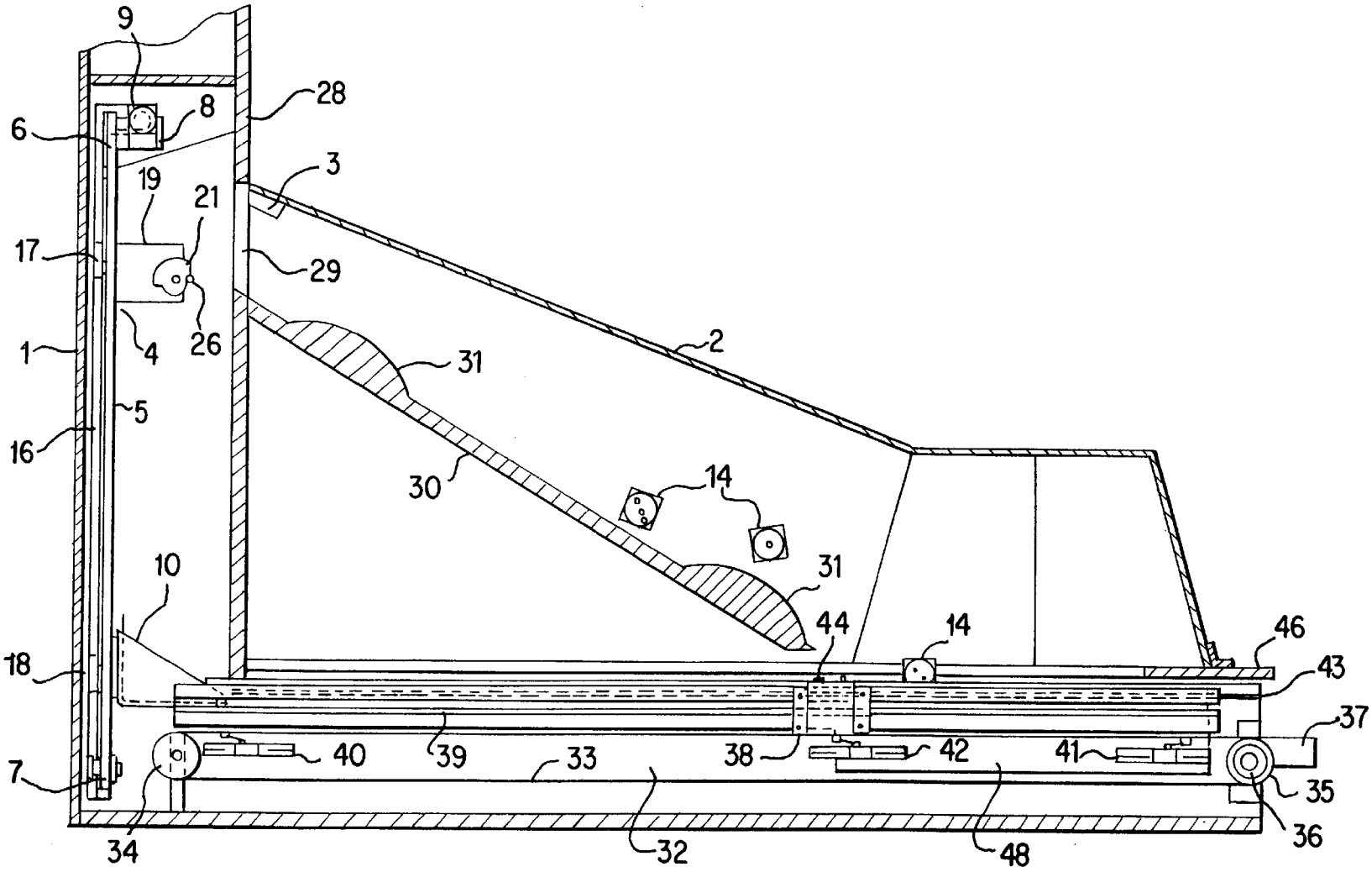
FIG. 1 shows a longitudinal section through the automatic dice game machine.
Figure 2:
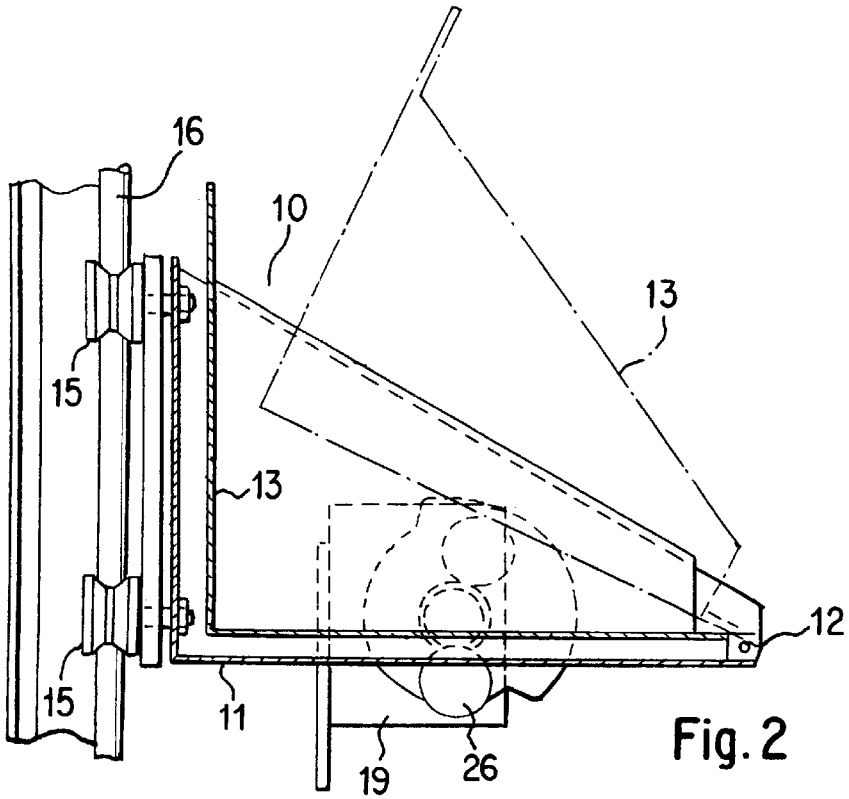
FIG. 2 shows an enlarged longitudinal section through the dice thrower of the automatic machine.
Figure 5:
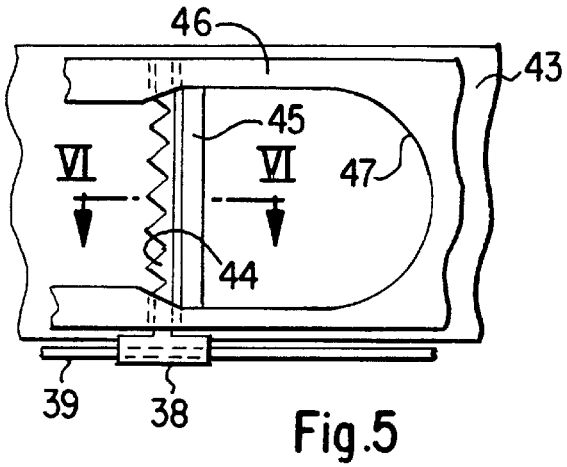
FIG. 5 shows an enlarged plan view of the scraper and the guide construction.
Figure 6:
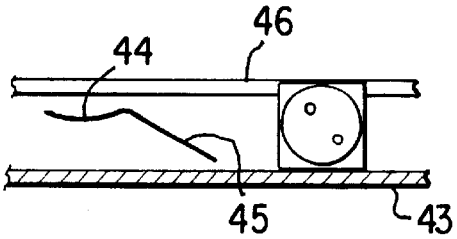
FIG. 6 shows a transverse section through same along line VI—VI in FIG. 5.
Figure 7:
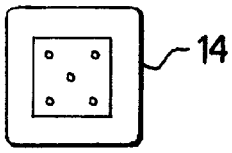
FIGS. 7 and 8 show a die with code marks.
Figure 8:
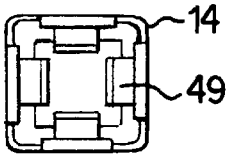
Figure 3:
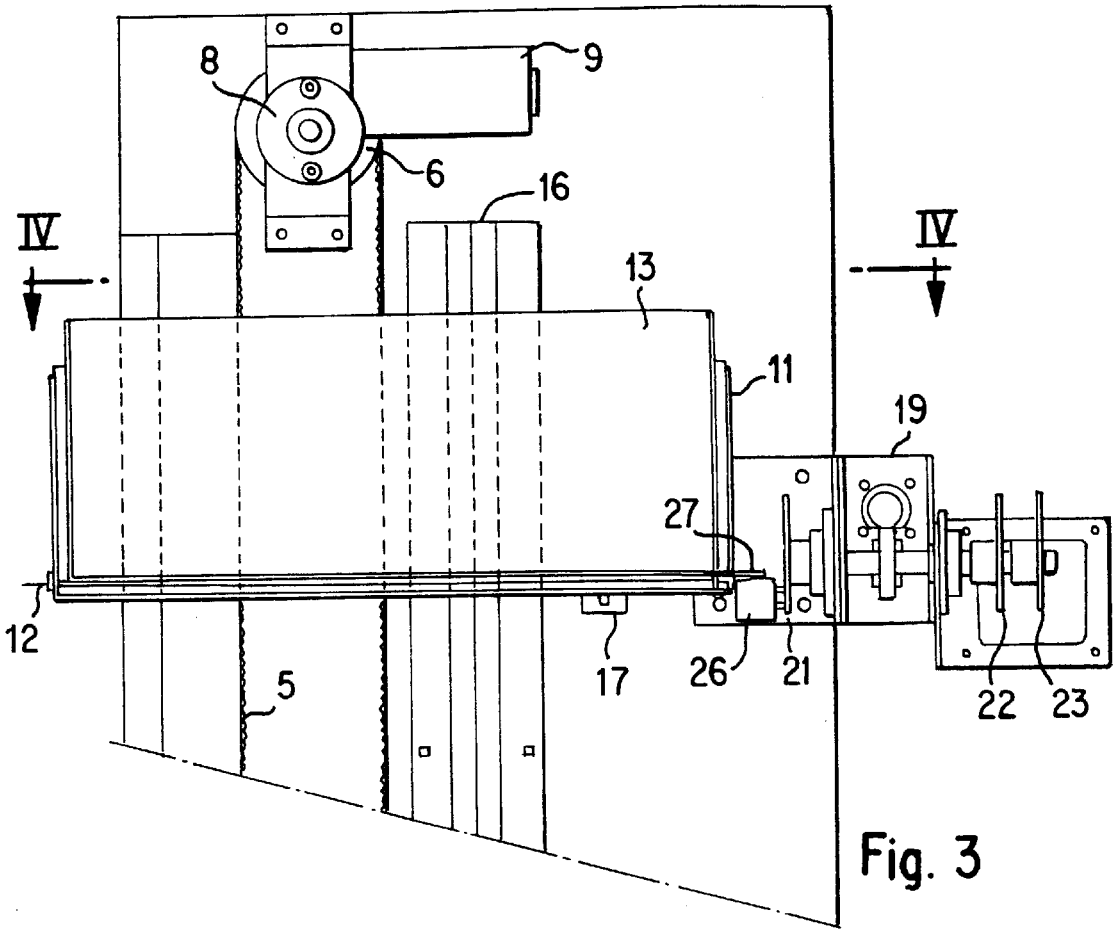
FIG. 3 shows a front view of the dice thrower.
Figure 4:
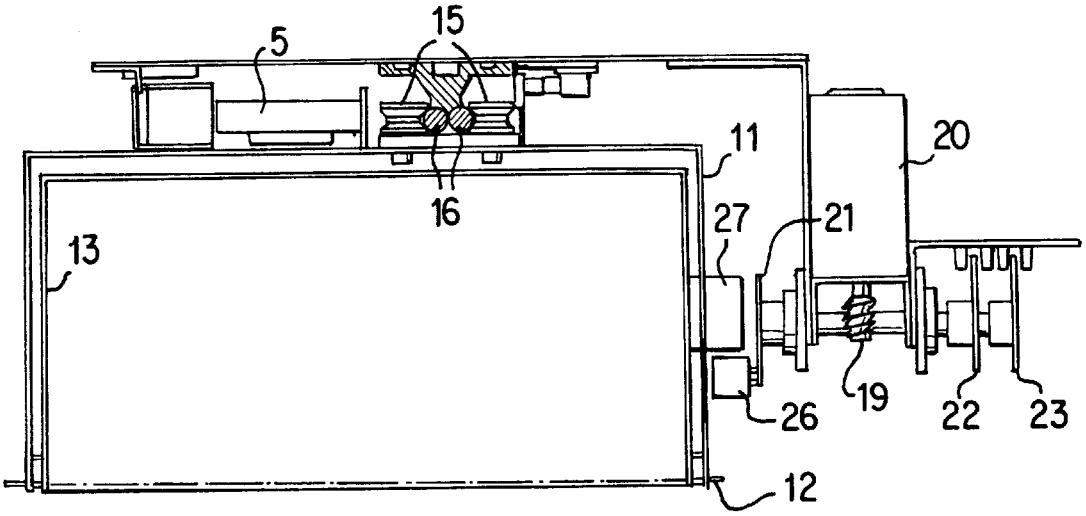
FIG. 4 shows a plan view of the dice thrower along the line IV—IV of FIG. 3.
Figure 9:
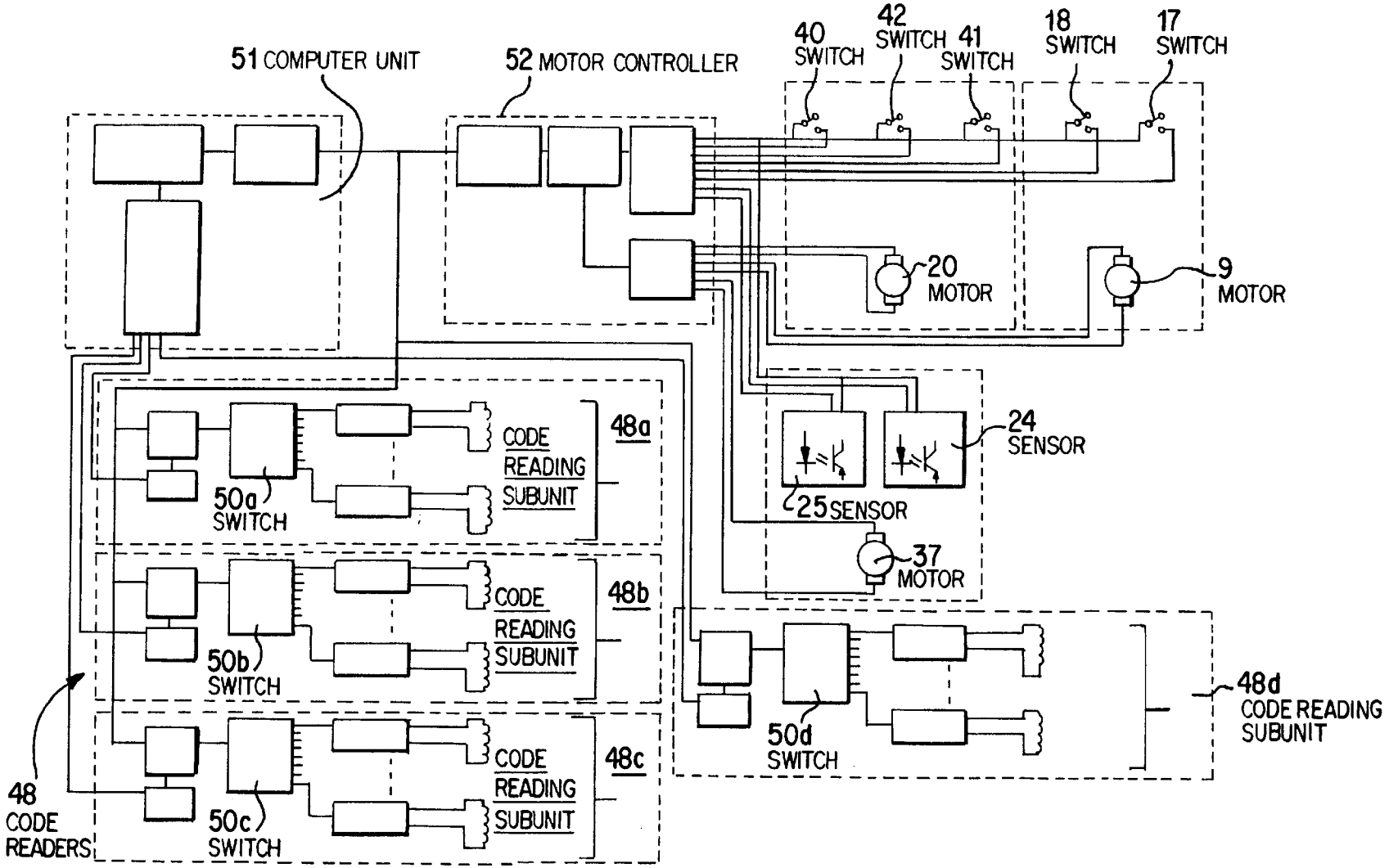
FIG. 9 shows an electrical diagram of the electrical circuit of the automatic machine.

It will seen from these figures that the automatic machine has a cabinet 1 which is covered an top by a hinged transparent cover 2 which is locked by a lock 3. A lift device 4 consisting of an endless toothed belt 5 which runs over two rollers 6–7 is provided in the cabinet 1. The upper roller 6 is mounted on the output shaft of a worm gear device 8 powered by an electric motor 9. A die thrower 10 capable of being moved vertically up and down is mounted on the toothed belt 5. This die thrower consists of a carrying tray 11 in which a tipping pan 13 that turns around a spindle 12 is mounted for throwing several dice 14 placed in the tipping pan. The carrying tray 11 is provided with guide rollers 15 that run vertically on guide rails 16. The progression of the dice thrower 10 is limited at the top by a switch 17 and at the bottom by a switch 18 which can turn off the electric motor 9 of the worm gear device 8. A worm gear device 19 with electric motor 20 is fitted against the lift device 4 in the upper part of the cabinet 1 for tipping the tipping pan 13. Cam discs 21–22–23 are mounted on the shaft of the worm screw of the worm gear device 19. These cam discs work in conjunction with an optical sensor 24 which determines the final horizon position of the tipping tray 13 and an optical sensor 25 which determines the final tipping position of the tipping pan 13, by switching off the electric motor 20. Cam disc 21 bears a tipping roller 26 which can exercise pressure on a lip 27 of the tipping pan 13 in order to make the tipping pan tip. An opening 29 is provided in the panel 26 of cabinet 1. Under this opening a slope 30 with bumps or other irregularities is provided for tumbling the dice rolling down the slope. Located at the bottom of the cabinet and at the foot of the slope 30 is a horizontal transport device 32 consisting of an endless toothed belt 33 running over two rollers 34–35 where one of the rollers is mounted on the output shaft of a warm gear 36 with electric motor 37. A scraper 38 is mounted on the toothed belt 32 the horizontal movement of which is guided by a guide rail 39. Both final positions of the scraper 38 are limited by switches 40–41, whereas a switch 42 ensures that the scraper always returns to the same position at the foot of the slope 30 before playing the next game. The dice 14 railing from the slope 30 end up on a horizontal receiving panel 43 above which the scraper 38 is free to move. This scraper has a toothed part 44 and an inclined part 45 enabling the dice to be tipped on the receiving panel during the movement of the scraper. A guide structure 46 with a guide opening with a semi-circular end 47 is located above the receiving panel 43 in order to impart a random movement to the dice. A reading unit with multiple code readers 48 is located under the receiving panel 43 for reading the symbols and code marks 49 with digital information on the dice 14. The reading unit consists of several sub-units 48*a*, 48*b*, 48*c*, and 48*d*, each of which consists of a control unit which actuates one by one a series of antennae by means of an electronic switch 50*a*, 50*b*, 50*c*, and 50*d* and thus reads the information from any of the dies lying uppermost. The reading unit works in conjunction with a central computer unit 51 for the comparison with a predetermined winning combination, which in the event of a win is notified to several coin operated game consoles set up in the game area (not shown). Players can take part in the dice game from any game console and these game consoles are so set up that the game can be participated in only during a preset period of time. The entire automatic machine is set in operation by a central motor controller 52.

The operation of the automatic dice game machine is described below.

The central computer unit 51 checks to see whether the same consoles set up in the game area have sufficient credit to allow the game to start. If so a visual and/or acoustic signal is given to indicate that bet is possible. After a given period of time the ability to bet is suspended. The central computer unit 51 starts the electric motor 20 and the worm gear device 19 via the motor control 52 with the result that the tipping roller 26 exerts pressure or the lip 27 of the tipping pan of the dice thrower 10 in which for example there are three dice and which are in the highest position so that the tipping pan tips about the spindle 14 in the direction of the incline 3C. When the optical sensor detects the end of the tipping movement of the tipping pan 13 the electric motor 20 is stopped. The dice 14 rolling out of the tipping tray roll down the slope 30 and turned in all directions by the bumps 31 an the slope 30. At the bottom the dice 14 land on the horizontal receiving panel 43 after they have passed through the guide opening of the guide structure 46. The motor drive 52 then again starts the electric motor 20 so that the tipping pan 13 turns downwards about the spindle 12, so that it again assumes a horizontal position. When the tipping pan 13 reaches the horizontal position this is determined by the optical sensor 24 which stops the electric motor 20. The central computer unit 51 then starts the electric motor 9 of the lift device 14 via the motor controller 52 as a result of which the toothed belt 5 moves the dice thrower 10 downwards until it reaches switch 18 and electric motor 9 is switched off. The central computer unit 51 now tells the reading unit with code readers 48 to read the dice 14 which are provided with code marks 49 and which are located on the receiving panel 43. When the predetermined winning combination is determined this is indicated audiovisually and communicated to the game consoles, with the players being given the chance to choose for another game or to be paid out. Thereafter the central computer unit 51 starts the electric motor 37 with the worm gear device 36 so that the toothed belt 33 moves the scraper 38 mounted on it towards the switch 41 until the switch is reached and the electric motor 37 is turned off. During this movement the sloping part 45 of the scraper moves the dice 14 in various directions. When the central computer unit 15 again starts the electric motor 37 via the motor 52, the toothed belt 33 moves the scraper 38 in the opposite direction towards the switch 40 With the result that the toothed part 44 of the scraper makes the dice 14 assume another position, making the likelihood that the three dice form a single line in the direction of motion extremely small. When the scraper 38 reaches the switch 43 the dice 14 are pushed into the dice thrower. The scraper 38 is then moved slightly in the opposite direction so that the dice thrower 10 is released after which the electric motor 37 comes to a halt. When the scraper reaches tine switch 42 during its previous movement it again becomes possible for players to make bets. The central computer unit 51 starts electric motor 9 via the motor controller 52 with the result that the toothed belt 5 moves the dice thrower 10 upwards with the dice 14 until switch 17 is reached, which then switches off electric motor 9. Afterwards the electric motor 37 is made to rotate in the opposite direction so that the toothed belt 33 with the scraper 38 is moved against the switch 42, which turns the electric motor 37 off and the scraper is returned to its original position. In this position the dice to be received can fall within a space on the receiving panel 43, which is bounded by the scraper 38, the semi-circular part 47 and the side pieces of the guide structure 46. When the game consoles indicate there is still credit available, the cycle describe above is repeated. Alternatively the automatic dice game machine returns to the rest state.

It, goes without saying that the parts described above may have any shape and dimensions whatsoever and may be replaced by other components which serve the same purpose.

What is claimed is:

1. Automatic dice game machine comprising a cabinet, a transparent cover which seals off an upper part of the cabinet, a dice thrower, several dice provided with symbols and code marks containing digital information and which can be placed in said dice thrower, a slope over which the dice roll down, said slope extending downwardly from an upper position of said dice thrower and having an upper surface that is visible through said transparent cover, a horizontal receiving panel located at a certain distance from a bottom edge of the slope for receiving the dice, a reading unit with code readers located under the receiving panel for comparing the symbols and code marks of the dice with a predetermined winning combination, a signaling device for communicating the winning combination, a lifting device for moving said dice thrower in a vertical direction between one end of the receiving panel and a top edge of the slope respectively, a scraper being movable over said receiving panel by a horizontal transport system, such that in one direction of motion the dice are tipped over and in the other direction of motion said dice are moved into said dice thrower.

2. Automatic dice game machine in accordance with claim 1, wherein the dice thrower comprises a carrying tray with a spindle, guide rollers that run along vertical guide rails and a tipping pan that is rotatably mounted to the spindle so that the pan can be tipped about said spindle.

3. Automatic dice game machine in accordance with claim 2, further comprising two switches that control electric circuits of the lifting device for the dice thrower and limit the vertical movement of the dice thrower.

4. Automatic dice game machine in accordance with claim 2, further comprising cam discs, a worm gear device and an electric motor for driving said worm gear.

5. Automatic dice game machine in accordance with claim 4, further comprising an optical sensor with switch for determining a horizontal end position of the tipping tray and an optical sensor with switch for detecting a final tipping position of the tipping pan, said sensors being capable of controlling the electric motor.

6. Automatic dice game machine in accordance with claim 1, wherein the slope located under the dice thrower is provided with a plurality of bumps in order to tumble the dice rolling down the slope.

7. Automatic dice game machine in accordance with claim 1, wherein a guide structure is located between the slope and the receiving panel for guiding the dice landing on the receiving panel, said guide structure being bounded by a guide opening with two side pieces and a semi-circular end, and wherein the movable scraper constitutes another end of the guide structure.

8. Automatic dice game machine in accordance with claim 1, wherein the lifting device further comprises a worm gear with an electric motor, two rollers, an endless toothed belt that rubs over the rollers and two switches that control electric circuits of the lifting device for the dice thrower and limit the vertical movement of the dice thrower, and wherein said dice thrower is mounted on said endless toothed belt.

9. Automatic dice game machine in accordance with claim 1, wherein the scraper is guided by a horizontal guide rail, and wherein a free end of the scraper stands at right angles to said directions of motion and comprises a sloping part and a toothed part for moving and tipping the dice on the receiving panel.

10. Automatic dice game machine in accordance with claim 9, wherein the horizontal transport system for moving the scraper comprises a toothed endless belt upon which said scraper is mounted, two rollers over which the endless belt runs, a worm gear device with an electric motor for driving said rollers and switches provided in an electric circuit of said electric motor for determining end positions and an intermediate position of said scraper.

11. An automatic dice game machine comprising a cabinet, a transparent cover that seals off an upper part of the cabinet, a dice thrower, several dice provided with symbols that can be positioned in said dice thrower, a slope over which the dice roll down, said slope extending downwardly from an upper position of said dice thrower and having an upper surface that is visible through said transparent cover, a horizontal receiving panel located at a predetermined distance from a bottom edge of the slope for receiving the dice, a lifting device for moving said dice thrower in a vertical direction between one end of the receiving panel and a top edge of the slope respectively, a scraper being movable over said receiving panel by a horizontal transport system, such that in one direction of motion the dice are tipped over and in the other direction of motion said dice are moved into said dice thrower.

12. Automatic dice game in accordance with claim 11, wherein the slope includes a plurality of irregularities for causing the dice rolling down said slope to tumble.

* * * * *